US006325897B1

(12) United States Patent
Ishino et al.

(10) Patent No.: US 6,325,897 B1
(45) Date of Patent: Dec. 4, 2001

(54) SHOE PRESS BELT WITH CHEMICALLY BONDED INNER OIL LAYER

(75) Inventors: Atsushi Ishino; Kenji Inoue; Tsutomu Ishii; Masatoshi Kono, all of Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/694,950

(22) Filed: Oct. 24, 2000

(30) Foreign Application Priority Data

Oct. 25, 1999 (JP) ..... 11-303155

(51) Int. Cl.[7] ..... D21F 3/02
(52) U.S. Cl. ..... 162/358.4; 162/901; 156/172
(58) Field of Search ..... 162/358.4, 901; 156/172, 289

(56) References Cited

U.S. PATENT DOCUMENTS 5,968,318 * 10/1999 Hasegawa et al. ..... 162/358.4

FOREIGN PATENT DOCUMENTS

2068800 * 5/1992 (CA) ..... 162/901

* cited by examiner

*Primary Examiner*—Karen M. Hastings
(74) *Attorney, Agent, or Firm*—Howson & Howson

(57) ABSTRACT

The problem of this invention is to inhibit the infiltration of a lubricating oil supplied to the contact area of the shoe with the belt into the high molecular weight elastic member, and to offer a shoe press belt which has an excellent performance improving durability of the friction surface, preventing flaking off phenomena, cracks, and breakage; and its manufacturing method. An endless shoe press belt the inner portion 1*a* of which is adapted to contact a shoe S of a papermaking machine, said inner portion 1*a* being composed of a high molecular weight elastic material, characterized in that the surface of said inner portion is provided with a protective oil 3 comprising an oil the viscosity of which is higher than that of a lubricating oil J supplied to the contact area of said inner portion with said shoe, or a paste-like oil having a certain consistency. It effectively prevents infiltration of the lubricating oil into the surface of the inner portion of the belt.

2 Claims, 6 Drawing Sheets

SHOE PRESS BELT WITH CHEMICALLY BONDED INNER OIL LAYER

SUMMARY OF THE INVENTION

This invention relates to a belt for a shoe press used in papermaking, and more particularly with the improvement of the durability of the shoe-contacting side of the belt, and to improvements in belt manufacturing methods.

A shoe press is an apparatus used to squeeze water out of a web of pulp in the pressing stage of a papermaking machine. There are two types of shoe presses: open and closed. The open type shoe press takes up a large amount of space and has the drawback that it diffuses oil. Therefore, the current trend is toward the use of the closed shoe press.

In a closed-type shoe press, a shoe press belt passes between a press roll and a shoe. A pulp web containing water is sandwiched between upper and lower felts, which pass between the shoe press belt and the press roll. Water contained in the web is squeezed out by the pressure between the press roll and the shoe.

A conventional shoe press belt is typically composed of an endless layer of a high molecular weight elastic substance, reinforced by a fabric. Since the belt is endless, its diameter is relatively small, and consequently its working conditions are unavoidably severe. Therefore, a lubricating oil is generally supplied from the periphery of the shoe to the contact area between the shoe and the belt in order to reduce friction.

However, as time passes, the lubricating oil infiltrates into the high molecular weight elastic member of the shoe press belt, and causes a gradual decrease in the durability of the belt. The lubricant causes a flaking off phenomenon, cracks and eventual breakage of the high molecular weight elastic member.

The general object of this invention is to solve the above-mentioned problem. More particularly, objects of the invention include the effective inhibition of the infiltration of lubricating oil into the interior of the high molecular weight elastic member of the belt, the improvement of the durability of the shoe-contacting surface of the belt and the prevention of the flaking off phenomenon, cracks and breakage of the high molecular elastic member.

To achieve the above-mentioned objects, an endless shoe press belt in accordance with the invention has its inner portion, which is adapted to contact a shoe of a papermaking machine, composed of a high molecular weight elastic material having a shoe-contacting surface containing a protective oil from the group consisting of an oil the viscosity of which is higher than that of the lubricating oil used to lubricate the contact area between a shoe press belt and a shoe, and an oil having a paste-like consistency. The inner portion of the belt is capable of effectively obstructing the infiltration of lubricating oil into the belt.

Moreover, according to the invention, a manufacturing method is provided wherein a protective oil is applied to the shoe-contacting surface of the belt, the protective oil being from the group consisting of an oil the viscosity of which is higher than that of the lubricating oil used to lubricate the contact area between a shoe press belt and a shoe, and an oil having a paste-like consistency. A chemically bonded structure capable of obstructing the infiltration of lubricating oil into the interior of the belt can be formed easily. Preferably, the belt is formed on a mandrel, and the application of protective oil to the shoe-contacting surface of the belt is carried out by coating the surface of the mandrel with the protective oil, and thereafter forming the belt on the oil-coated mandrel by a series of steps including the step of forming the inner layer of the belt by applying a high molecular weight elastic material to the coated mandrel.

Other objects, details and advantages of the invention will be apparent from the following detailed description when read in conjunction with the drawings.

DETAILED DESCRIPTION

Figure 11:
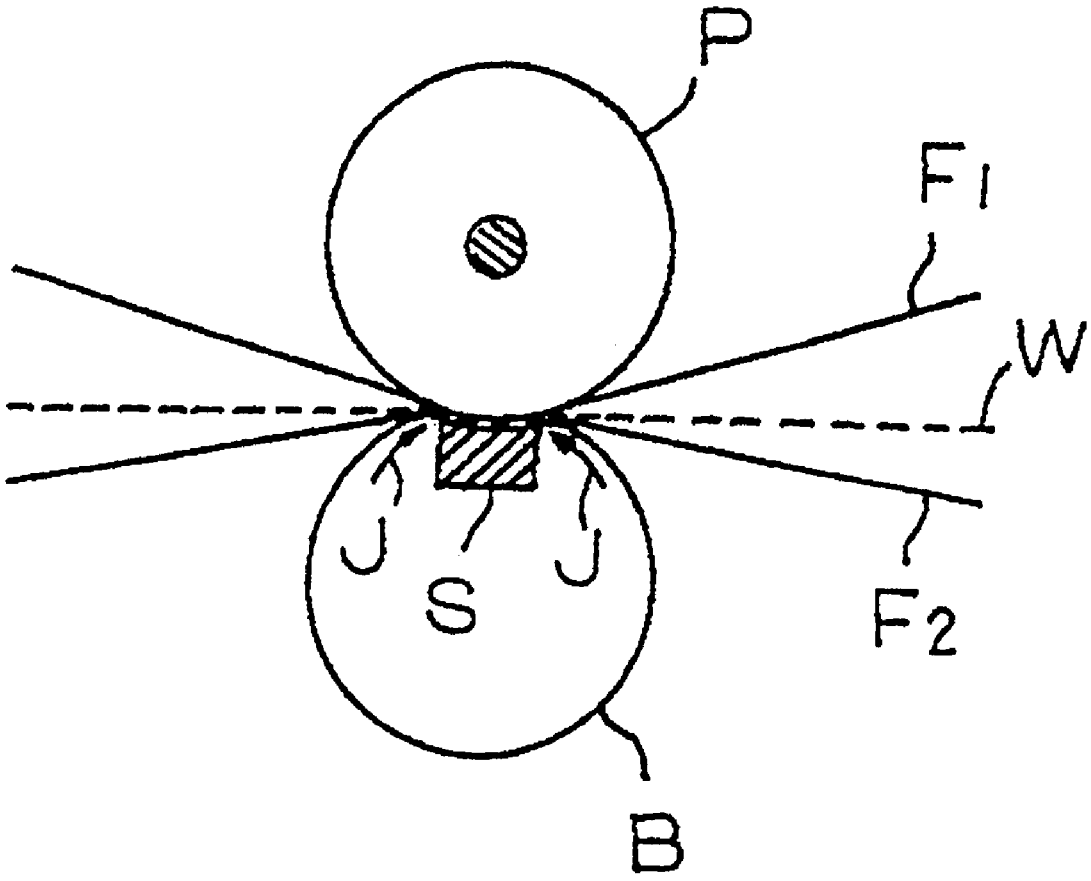
FIG. 11 is a schematic view of a shoe press apparatus in a papermaking machine.

A typical closed type shoe press apparatus is shown in FIG. 11. P represents a press roll, S denotes a shoe, and B is a belt for the shoe press, respectively. The shoe press belt B is adapted to run along with an upper felt F1, a web W (shown in a broken line), and a lower felt F2. Water is squeezed by the pressure between the press roll P and the shoe S.

To reduce friction, and thereby alleviate the severe working condition resulting from the small diameter of the belt B, lubricating oil J is supplied from the periphery of the shoe S to the contact area between the shoe and the belt B.

As mentioned previously, over time the lubricating oil infiltrates the high molecular weight elastic material of the shoe press belt, causing a gradual decrease in its durability, a flaking off phenomenon, the formation of cracks, and eventual breakage.

Next, embodiments of the invention will be explained referring to FIGS. 1–7.

Figure 1:
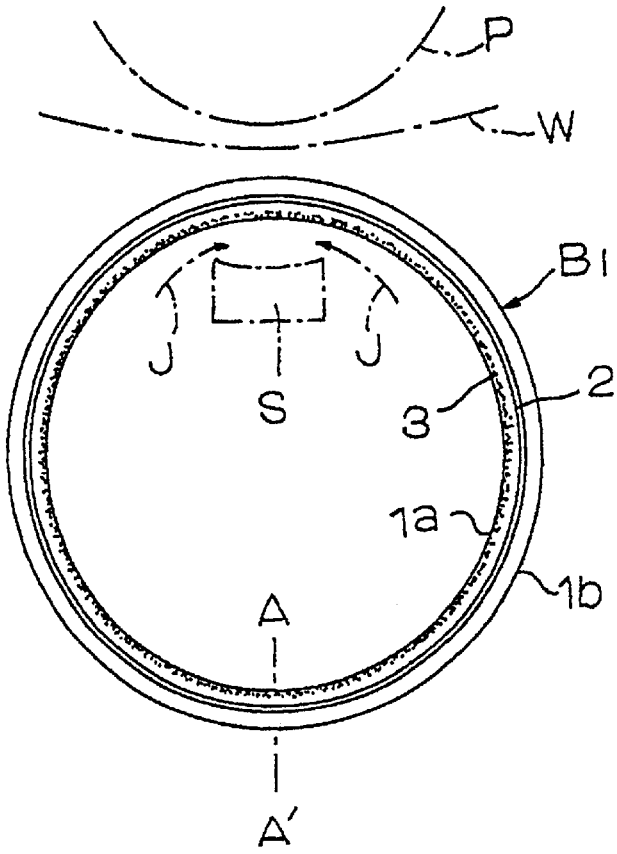
FIG. 1 is a schematic sectional view of a belt in accordance with the invention.
Figure 2:
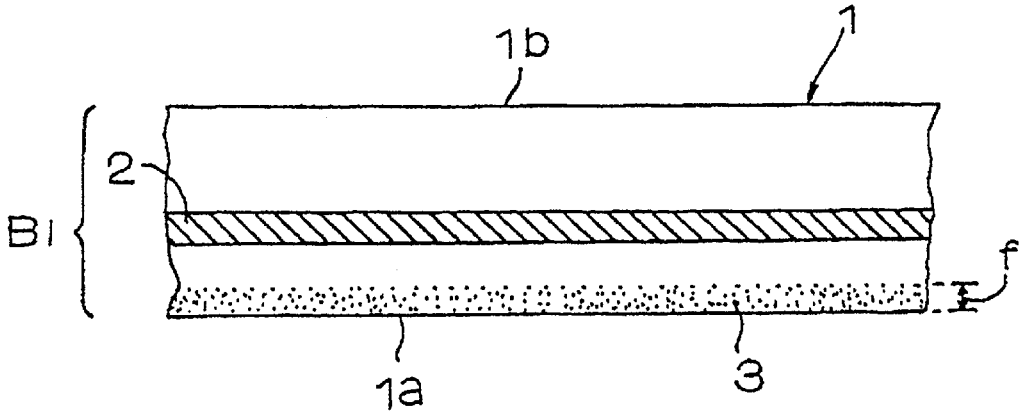
FIG. 2 is an enlarged sectional view taken on plane A–A' in FIG. 1.

Referring to FIGS. 1 and 2, B1 represents an endless belt consisting of a composite laminate of a high molecular weight elastic member 1 and a base member 2. Ear portions. (not shown) are formed at both sides to facilitate installation of the belt on a papermaking machine.

When the belt B1 is used in a papermaking machine, its inner portion 1*a* comes into contact with the shoe S, and also receives a lubricating oil J supplied from the periphery of the shoe. Also, the outer portion 1*b* of the belt B1 is adapted to carry the web W in cooperation with the press roll P, and functions to squeeze water from the web W.

The high molecular weight elastic member 1 is composed of polyurethane elastomer, or similar material, having a hardness of 80–98° (JIS-A). Of course, it is possible to form the inner portion 1*a* and the outer portion 1*b* from the same high molecular weight elastic material, or to use different high molecular weight elastic materials for portions 1*a* and 1*b* respectively.

To improve the strength of the belt both in the machine direction and in the cross direction, a base member 2 is arranged within the high molecular weight elastic member 1. Various compositions may be used for the base member 2, and its composition is not limited. In case a fabric is employed as the base member, it is desirable to have the high molecular weight elastomeric material filled into the gaps between the warp and the weft so that the base member is well integrated with the high molecular weight elastic member.

To prevent lubricating oil J from infiltrating into the inner portion 1*a* of the belt B1, a protective oil 3 is arranged in the surface of the belt as shown by the dotted pattern in FIG. 2.

The above-mentioned protective oil 3 infiltrates the surface of the inner portion 1*a* of the high molecular weight elastic member 1 to a very shallow depth f. The strength of the high molecular weight elastic member 1 is not adversely affected by the infiltration of the protective oil. Further, as to the appropriate amount of the depth f from the surface of the inner portion 1*a* in which the protective oil 3 penetrates, it has been experimentally confirmed that the depth in the range from 10–1000 $\mu$m brings about an excellent result.

The protective oil 3 should be an oil having a viscosity higher than that of the lubricating oil J supplied to the contact area of the inner portion of the belt with the shoe, or an oil (i.e. a grease) having a paste-like consistency in the range from 200–400, tested at 25° C. by the method of testing defined in "JIS K2560 (K2220)", namely, "cone type consistency testing method of grease".

For the protective oil, satisfactory materials may be selected from dimethyl silicone oil, or silicone oil of methyl styryl modified type or a long chain alkyl modified type. Moreover, the forms of the oil may be oily, aqueous solution type, emulsion type, solvent type, or paste-like containing a filler, such as fine powder silica.

More specifically, the kinematic viscosity of the protective oils should be in the range from about 300–500,000 cSt, which is higher than that of lubricating oils used in shoe presses at the contacting area between the shoe press belt and the shoe. Stated another way, the oils having the characteristic of 30–100 according to the ISO standard VG (center value of the kinematic viscosity cSt at 40° C.) are suitable. For instance, petroleum gear oil is generally suitable. The underlying reason is that the viscosity index (VI) of the lubricating oil used in a papermaking machine is generally in the range from 100–250.

Next, a method of manufacturing the belt in accordance with the invention will be explained. In FIGS. 3–8, M is a rotatable mandrel, C is a coater bar and N is a nozzle. The mandrel M has the diameter which corresponds to the diameter of the belt B1 which is to be manufactured. The nozzle N is adapted to move along the mandrel M in the longitudinal direction, i.e. parallel to the axis of rotation of the mandrel. For clarity, the drawing illustrates only one nozzle; but actually, there should be two nozzles, one for spreading the protective oil material and another for spreading the high molecular weight elastic material. Each nozzle is connected to a storage tank (not shown) for the protective oil or the high molecular weight elastic material. The coater bar C is adapted to move through minute distances in the vertical direction so that it may adjusted to maintain the thickness of the protective oil material and the high molecular weight elastic material, spread with the nozzles N.

Figure 3:
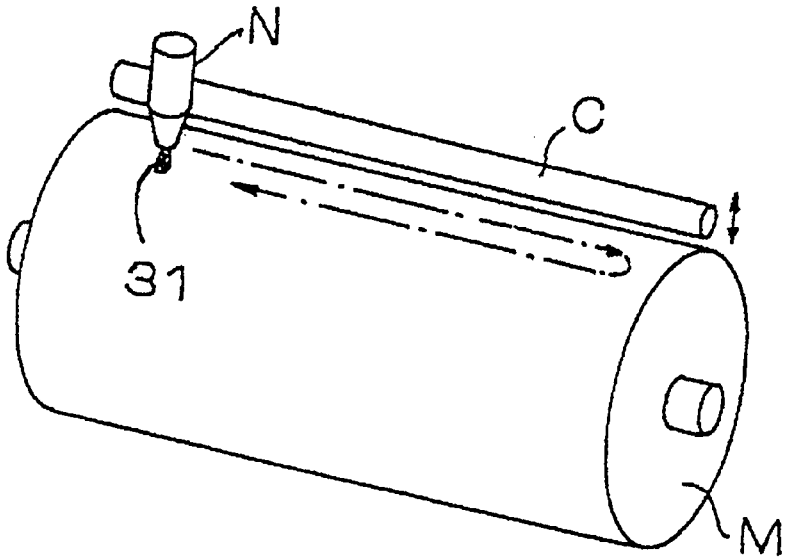
FIG. 3 is a schematic perspective view showing a mandrel used to manufacture the belt and peripheral equipment.

The belt B1 is manufactured by using the surface of the mandrel M. Firstly, a protective oil 31 is spread with a nozzle N as shown in FIG. 3 on the surface of the mandrel M. Depending upon the circumstances, the protective oil 31 may be spread by spraying or by hand.

Figure 4:
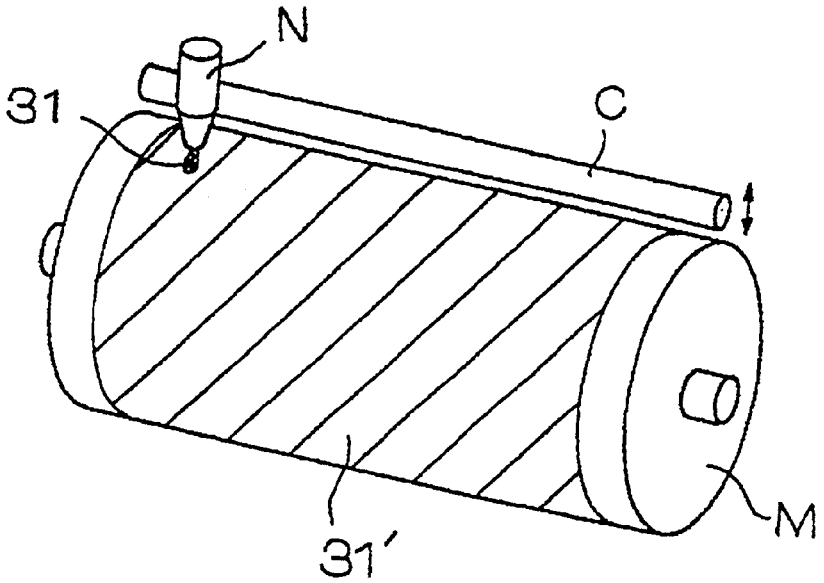
FIG. 4 is a perspective view showing the process for spreading protective oil on the surface of the mandrel.

Next, as shown in FIG. 4, using a different nozzle N, the high molecular weight elastic material 11 is spread on the surface 31' of the protective oil 31 (as shown by hatching). As a result, the previously spread protective oil material 31 infiltrates into the inner portion of the layer of high molecular weight elastic material 11.

Figure 5:
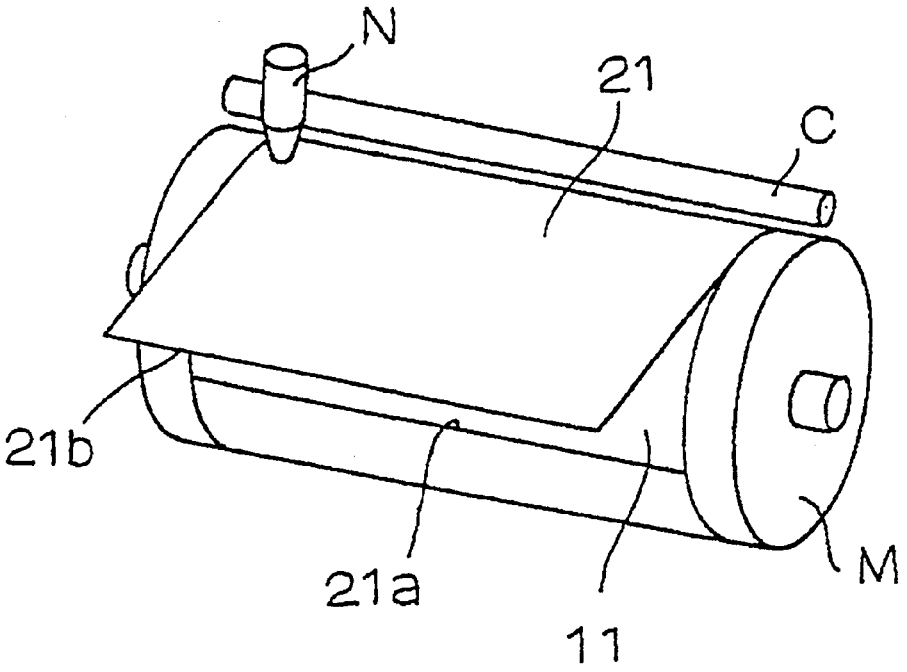
FIG. 5 is a perspective view showing the process of forming a base member after spreading a high molecular weight elastic member constituting the inner portion of the belt onto the mandrel on which protective oil was previously spread.

Next, the high molecular weight elastic material 11 thus spread is allowed to semi-cure at room temperature or with the aid of a heating apparatus (not shown). The high molecular weight elastic material 11 forms the inner portion 1*a* of belt B1. As shown in FIG. 5, after semi-curing, a woven fabric 21 is wound on the surface of the high molecular weight elastic material 11 to form the base member. The rear end 21*b* of the woven fabric 21 is cut at the same position as the front end 21*a*, and both ends 21*a* and 21*b* are arranged to oppose each other.

Figure 6:
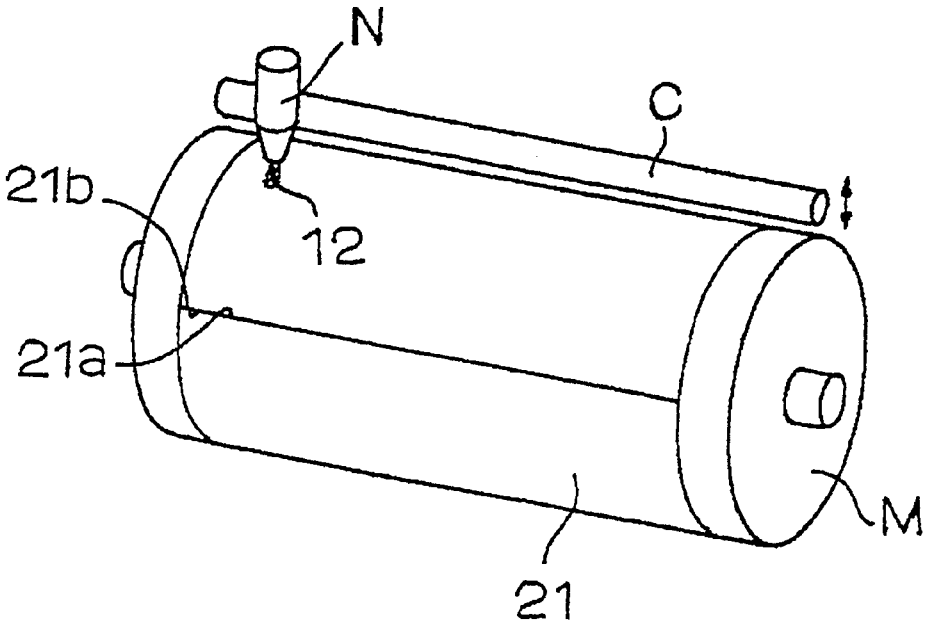
FIG. 6 is a perspective view showing the process of spreading a high molecular weight elastic member constituting the outer portion of the belt onto the base member.

Next, the high molecular weight elastic material 12 is spread with a nozzle N as shown in FIG. 6. The high molecular weight elastic material 12 first fills the gaps of the warp and weft of the woven fabric 21, and then forms the outer portion 1*b* of the belt. Thereafter, The outer portion 1*b* is left at room temperature or heated by a heating means (not shown) for curing.

Figure 7:
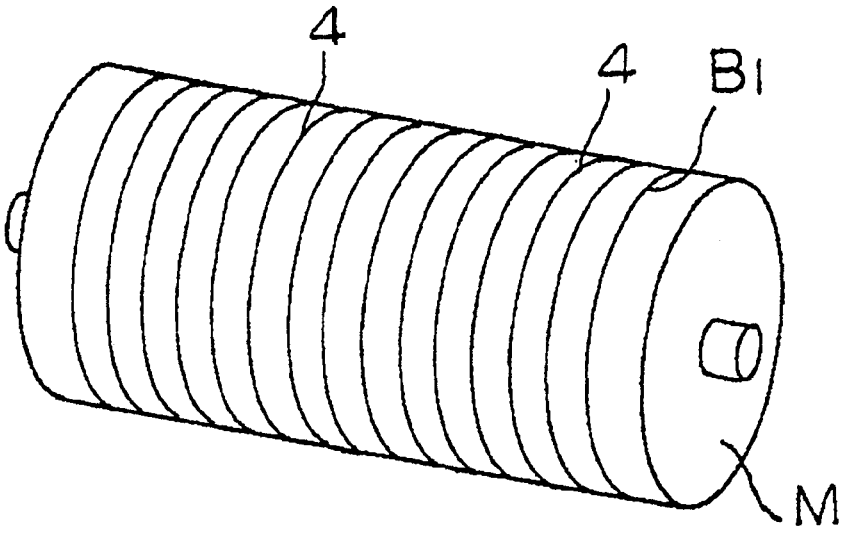
FIG. 7 is a perspective view showing grooves formed in the outer surface of the high molecular weight elastic member.

The above-mentioned high molecular weight elastic materials 11 and 12 may be the same materials, or they can be different materials, depending upon the required properties of the belt B1. After the curing of the high molecular weight elastic materials 11 and 12 which compose the belt B1, the surface of the outer portion is ground in order to straighten and smooth the outer surface of the belt and to obtain a desired belt thickness. In addition, if necessary, grooves 4 for draining water are formed with a groove cutting apparatus on the surface of the belt as shown in FIG. 7. Thereafter, the belt is detached from the mandrel M, as a complete belt B1 in accordance with the invention.

The infiltration of the protective oil 3 creates a chemical bonding between the protective oil 3 and the high molecular weight elastic material 1 by infiltration into the cross-linking structure, namely, the interior of the molecular chains. Thus, the protective oil 3, having infiltrated to a very shallow depth into the surface of the inner portion 1*a* of belt B1, prevents the lubricating oil from infiltrating into the high molecular weight elastic member 1 by the action of a chemically bonded structure. The viscosity of the protective oil 3 (300–500,000 cSt) is greater relative to the viscosity of the lubricating oil J of a papermaking machine (100–250), so that the lubricating oil of the papermaking machine will be easily caught by the bonded structure between the protective oil 3 and the high molecular weight elastic member 1. Thus, the lubricating oil will be prevented from permeating into the high molecular weight elastic member 1.

Figure 10:
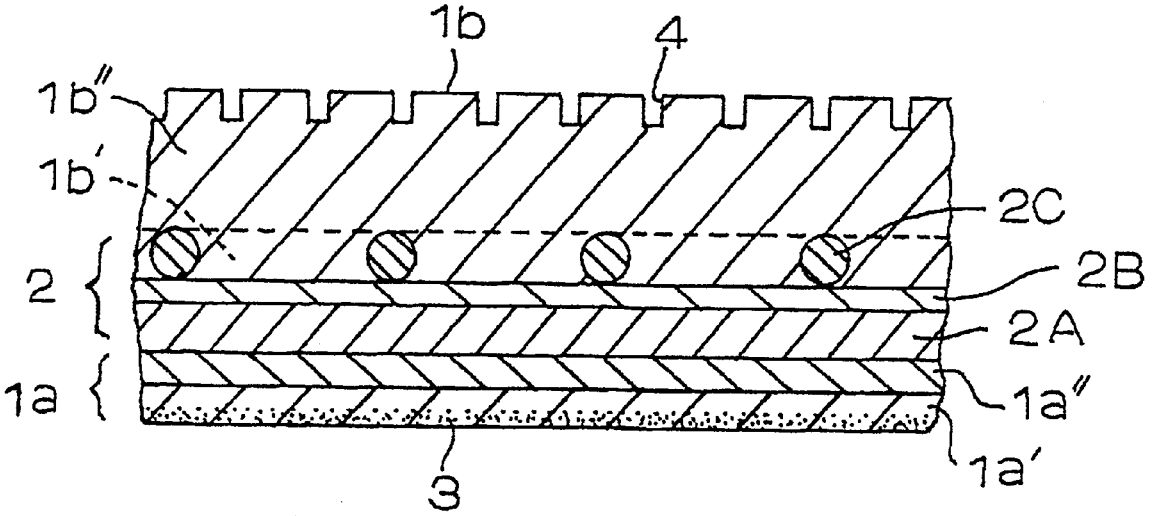
FIG. 10 is a transverse sectional view of an example of a belt in accordance with invention.

By way of example, referring to FIG. 10, a paste-like protective oil 3, having a viscosity of 350,000 cSt and comprising silicone oil with fine powdered silica added, was uniformly spread on a mandrel M to an areal weight of 5 g/m$^2$. On top of that coating, thermosetting urethane resin 1*a*', having a viscosity of 200,000 cSt, was applied to a thickness of 0.5 mm. Afterwards, the thermosetting urethane resin was semi-cured by a heating means, and thereafter, the same thermosetting urethane resin 1*a*" was spread to a thickness of 0.5 mm so the inner portion 1*a* of the belt had a total thickness of 1 mm.

Figure 8:
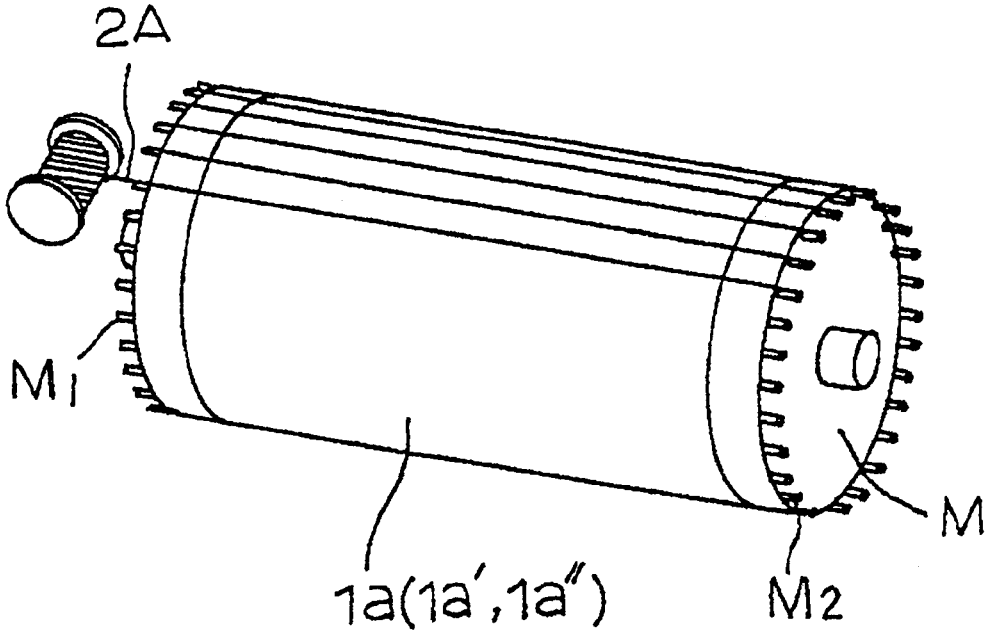
FIG. 8 is a perspective view showing the stretching of the weft elements of the base member after the high molecular weight elastic member constituting the inner portion of the belt has been formed over the protective oil.

Next, as shown in FIG. 8, weft elements 2A (polyester multifilament of 4500d) were stretched with a proper tension between a plurality of hooks M1, M2 provided at the 3 mm pitch on the respective ends of the mandrel. Then, thermosetting urethane resin 2B was spread on the above-mentioned weft elements 2A so that the weft elements 2A were coated to a total thickness (of weft elements 2A and resin 2B) of 1 mm, which is adequate assuming that the diameter of the weft elements 2A is 0.7 mm).

Figure 9:
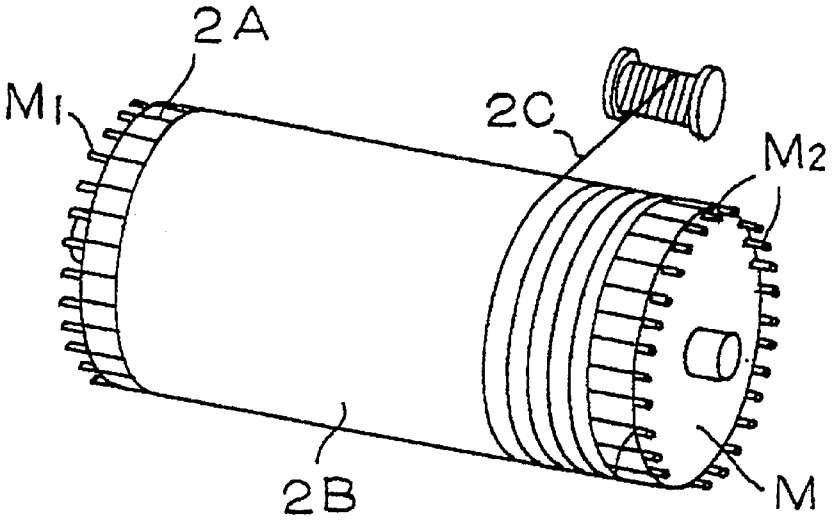
FIG. 9 is a perspective view showing the winding of the warp element of the base after the weft elements have been coated with a resin.

Next, as shown in FIG. 9, by rotating the mandrel M, a warp element 2C (polyester multifilament of 4500d) was wound on the thermosetting urethane resin 2B at a pitch of 3 mm. The starting end and the terminal end of the warp element 2C were fastened using the hooks M1 and M2. Thus (referring again to FIG. 10) a base member 2 was formed by the three elements, namely, the weft element 2A, the coating resin 2B and the warp element 2C.

Next, thermosetting urethane resin 1*b*' was spread on the warp element 2C. In this process, a resin thickness (about 1 mm) adequate to cover the warp element 2C was first secured. Thereafter, the thermosetting urethane resin 1*b*" was further spread by 2 mm or more, so that the outer portion 1B, having a total thickness of 3 mm, was formed.

Although all resins were composed of thermosetting urethane resin in the example, it should be understood that the layers are not distinctly separated from one another as shown schematically in FIG. 10. In fact the layers become integrated with one another so that there is no well-defined interface between layers.

Thereafter, all resins were completely cured by heat while rotating the mandrel M, the surface was ground and straightened to 4.7 mm in the total thickness, and the surface was made smooth. Grooves 4 for draining water were formed in the circumferential direction with a groove cutting apparatus on the smoothed surface. The belt was then detached from the mandrel M, and the belt B1 in accordance with the invention was obtained.

Fragments of the belt B1 obtained as described above were cut in the direction of its thickness, and the distribution of the protective oil 3 was measured. As a result, it was confirmed that the protective oil 3 existed in the resin from the inner surface to a depth of 30 $\mu$m in the inner portion 1*a* of the belt.

A laboratory dish was filled with a lubricating oil used in a papermaking machine. Fragments of the belt B1 in accordance with the invention were arranged with their inner portions 1*a* in contact with the lubricating oil, and left for 10 days. The fragments were then cut thickness-wise in layers to determine the distribution of the lubricating oil in the thickness direction. No lubricating oil was detected in the interior of the belt, confirming that the protective oil 3 which infiltrated into the inner portion 1*a* effectively produced a barrier preventing the lubricating oil from permeating into the belt B1.

In summary, the endless shoe press belt in accordance with the invention has its inner portion, which is adapted to contact a shoe of a papermaking machine, composed of a high molecular weight elastic material having a shoe-contacting surface coated with a protective oil from the group consisting of an oil the viscosity of which is higher than that of the lubricating oil used to lubricate the contact area between a shoe press belt and a shoe, and an oil having a paste-like consistency. The protective oil, which infiltrates a short distance into the inner portion of the belt serves as a barrier preventing the infiltration of the shoe press lubricating oil into the belt, and thereby improving the durability (including wear and abrasion resistance and bending and fatigue strength) of the belt. Since the strength of the high molecular weight elastic material of the belt is not adversely affected, a shoe press belt is obtained which is suitable for the high speed operation of, and high pressures encountered in, the shoe press sections of current papermaking machinery.

Moreover, according to the invention, a manufacturing method is provided wherein, using a mandrel, a protective oil is applied to the shoe-contacting surface of the belt, the protective oil being from the group consisting of an oil the viscosity of which is higher than that of the lubricating oil used to lubricate the contact area between a shoe press belt and a shoe, and an oil having a paste-like consistency. A chemically bonded structure formed by the protective oil and the high molecular weight elastic material of the belt, easily obstructs the infiltration of shoe press lubricating oil into the belt.

What is claimed is:

1. An endless shoe press belt having an inner portion adapted to contact a shoe of a papermaking machine, said inner portion being composed of a high molecular weight elastic material having a shoe-contacting surface containing a protective oil from the group consisting of an oil the viscosity of which is higher than that of the lubricating oil used to lubricate the contact area between a shoe press belt and a shoe, and an oil having a paste-like consistency, said protective oil extending into the elastic material from the inner shoe-contacting surface thereof to a depth in the range from 10–1000 $\mu$m, and forming with the high molecular weight elastic material a shallow, chemically bonded layer, said chemically bonded layer being sufficient to prevent lubricating oil from infiltrating through the chemically bonded layer into the high molecular weight elastic material.

2. In a shoe press comprising a shoe, an endless shoe press belt comprising a high molecular weight elastic material having an inner shoe-contacting surface which contacts said shoe over a contact area, a supply of lubricating oil and a lubricator arranged to deliver said lubricating oil to said contact area, the improvement wherein said inner shoe contacting surface of the elastic material contains a protective oil from the group consisting of an oil the viscosity of which is higher than that of said lubricating oil, and an oil having a paste-like consistency, said protective oil extending into the elastic material from the inner shoe-contacting surface thereof to a depth in the range from 10–1000 $\mu$m, and forming with the high molecular weight elastic material a shallow, chemically bonded layer, said chemically bonded layer being sufficient to prevent lubricating oil from infiltrating through the chemically bonded layer into the high molecular weight elastic material.

* * * * *